US010465321B2

(12) United States Patent
Yoshida et al.

(10) Patent No.: US 10,465,321 B2
(45) Date of Patent: Nov. 5, 2019

(54) SEWING MACHINE

(71) Applicant: JUKI CORPORATION, Tokyo (JP)

(72) Inventors: Junichi Yoshida, Tokyo (JP); Toshiki Sugiyama, Tokyo (JP)

(73) Assignee: JUKI CORPORATION, Tama-shi, Tokyo (JP)

( * ) Notice: Subject to any disclaimer, the term of this patent is extended or adjusted under 35 U.S.C. 154(b) by 199 days.

(21) Appl. No.: 15/404,602

(22) Filed: Jan. 12, 2017

(65) Prior Publication Data

US 2017/0204547 A1 Jul. 20, 2017

(30) Foreign Application Priority Data

Jan. 14, 2016 (JP) ..... 2016-004906

(51) Int. Cl.
*D05B 19/14* (2006.01)
*D05B 69/18* (2006.01)
*D05B 69/26* (2006.01)

(52) U.S. Cl.
CPC ..... *D05B 19/14* (2013.01); *D05B 69/18* (2013.01); *D05B 69/26* (2013.01)

(58) Field of Classification Search
CPC ..... D04B 19/14; D04B 69/18; D04B 69/26
USPC ..... 700/134–138
See application file for complete search history.

(56) References Cited

U.S. PATENT DOCUMENTS 6,450,110 B1 * 9/2002 Bruhl ..... D05B 19/12 112/75
6,629,015 B2 * 9/2003 Yamada ..... D05B 19/08 112/102.5
6,959,657 B1 * 11/2005 Duval ..... D05B 19/14 112/272
8,146,521 B2 * 4/2012 Nakamura ..... D05B 27/22 112/102.5
8,220,402 B2 * 7/2012 Ukai ..... D05B 3/04 112/102.5
8,245,656 B2 * 8/2012 Mori ..... D05B 19/12 112/456
2005/0016428 A1 1/2005 Koerner
2006/0015209 A1 * 1/2006 Schweizer ..... D05B 19/02 700/136
2006/0213415 A1 * 9/2006 Konig ..... D05B 19/14 112/475.01
2007/0272136 A1 * 11/2007 Shimizu ..... D05B 11/00 112/2

(Continued)

FOREIGN PATENT DOCUMENTS

JP 2006-517449 A 7/2006
JP 4724938 B2 7/2011

*Primary Examiner* — Danny Worrell
*Assistant Examiner* — Larry D Worrell, Jr.
(74) *Attorney, Agent, or Firm* — Brinker Biddle & Reath LLP

(57) ABSTRACT

A sewing machine includes a sewing machine motor serving as a drive source for driving the vertical movement of a needle bar, a control part for controlling the sewing machine motor such that a sewing pitch coincides with a set value, and imaging part for imaging a seam formed in a workpiece at a needle drop position. The control part obtains the length of the most recent seam from an image of the most recent seam imaged by the imaging part and also compares the length of the most recent seam with the set value of the sewing pitch to thereby correct the number of rotations of the sewing machine motor.

12 Claims, 5 Drawing Sheets

(56) References Cited

U.S. PATENT DOCUMENTS

| | | | | |
|---|---|---|---|---|
| 2008/0078313 | A1* | 4/2008 | Hamajima | D05B 11/00 112/117 |
| 2009/0188415 | A1* | 7/2009 | Tokura | D05B 19/10 112/470.01 |
| 2010/0031860 | A1* | 2/2010 | Shimizu | D05B 27/20 112/221 |
| 2010/0199902 | A1* | 8/2010 | Mori | D05B 19/12 112/456 |
| 2012/0048163 | A1* | 3/2012 | Tokura | D05B 3/06 112/447 |
| 2012/0073484 | A1* | 3/2012 | Nakamura | D05B 19/12 112/154 |

* cited by examiner

SEWING MACHINE

CROSS-REFERENCE TO RELATED APPLICATION

The present invention claims the benefit of priority of Japanese Patent Application No. 2016-004906 filed on Jan. 14, 2016, the disclosure of which is incorporated herein by reference.

TECHNICAL FIELD

The present invention relates to a sewing machine which performs sewing at a constant sewing pitch.

BACKGROUND ART

There is known a sewing machine which images a workpiece on a needle plate using an optical element fixedly mounted on the frame of the sewing machine, obtains the amount of movement of the workpiece from the imaged data, and controls a sewing machine motor so as to perform a needle drop according to a predetermined movement amount, thereby maintaining a sewing pitch at a set value (see, for example, JP-B-4724938 and JP-A-2006-517449)

However, the above conventional sewing machine obtains the workpiece movement amount and controls the sewing machine motor so as to perform the needle drop when the workpiece is moved at the set sewing pitch.

Thus, even when there is generated an error in an actually formed seam with respect to the set sewing pitch, this error cannot be corrected, thereby raising a fear that the sewing can be continued with the error uncorrected.

SUMMARY OF THE INVENTION

An embodiment of the present invention is a sewing machine which comprises a sewing machine motor serving as a drive source for driving the vertical movement of a needle bar, and a control part for controlling the sewing machine motor such that a sewing pitch coincides with a set value, wherein, there is further included an imaging part for imaging a seam formed in a workpiece at a needle drop position, and the control part obtains the length of the most recent seam from an image of the most recent seam imaged by the imaging part and also compares the length of the most recent seam with the set value of the sewing pitch to thereby correct the number of rotations of the sewing machine motor.

It is preferable that, in the sewing machine according to the embodiment, the multiple imaging parts are arranged around the needle bar.

It is preferable that, in the sewing machine according to the embodiment, the control part obtains the moving direction of the workpiece from images of the workpiece imaged by the multiple imaging parts, selects one of the multiple imaging parts according to the thus-obtained moving direction, obtains the length of the most recent seam from the image imaged by the selected imaging part, and compares the length of the most recent seam with the set value of the sewing pitch to thereby correct the number of rotations of the sewing machine motor.

It is preferable that, in the sewing machine according to the embodiment, the control part obtains the moving direction of the workpiece from the images of the workpiece imaged by the multiple imaging parts, composes the images of the most recent seam imaged by the multiple imaging parts to obtain the length of the most recent seam, and compares the length of the most recent seam with the set value of the sewing pitch to thereby correct the number of rotations of the sewing machine motor.

It is preferable that, in the sewing machine according to the embodiment, the control part obtains the moving direction of the workpiece from the image of the workpiece imaged by any one of the multiple imaging parts.

It is preferable that, in the sewing machine according to the embodiment, the control part obtains the moving direction of the workpiece from the images of the workpiece imaged by the multiple imaging parts, according to the thus-obtained moving direction, identifies the seam extending along the moving direction from multiple seams imaged by the imaging parts as the most recent seam, and compares the length of the identified most recent seam with the set value of the sewing pitch to thereby correct the number of rotations of the sewing machine motor.

The sewing machine according to the embodiment includes the control part which obtains the length of the most recent seam from the image of the most recent seam imaged by the imaging part and compares the length of the most recent seam with the set value of the sewing pitch to increase or decrease the number of rotations of the sewing machine motor to thereby correct it. Thus, an error generated in a seam actually formed can be reflected on the sewing pitch adjustment control. Therefore, an actual sewing pitch can be brought closer to the set value, thereby enabling enhanced sewing quality.

DETAILED DESCRIPTION

Outline of Embodiment

Figure 1:
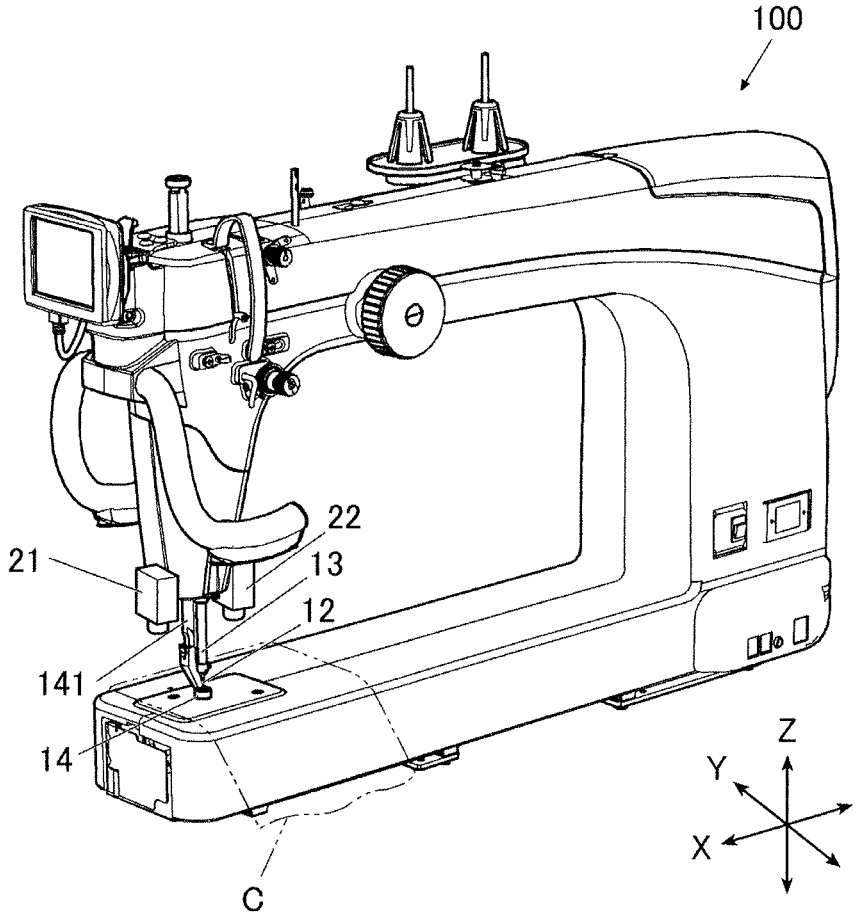
FIG. 1 is a perspective view of a sewing machine according to an embodiment of the present invention.

Description is given below of a sewing machine according to the embodiment of the present invention with reference to the drawings. FIG. 1 is a perspective view of a sewing machine 100.

Here, the sewing machine 100 of this embodiment is capable of performing so called free motion sewing in which the operator of the sewing machine arbitrarily feeds a fabric C serving as a workpiece on a needle plate.

The sewing machine 100 includes a needle bar vertical movement mechanism for vertically moving a needle bar 13 holding a sewing needle 12 in the lower end thereof, a shuttle mechanism for capturing a needle thread passed through the sewing needle and twining it around a bobbin thread, a balance mechanism for lifting up the needle thread to form a nodule, a thread tension device for applying specific tension to the needle thread, a sewing machine frame 11 for storing or holding the above composing elements, and a control unit 90 serving as a control part for controlling the operations of the respective elements.

The above-mentioned needle bar vertical movement mechanism, shuttle mechanism, balance mechanism, thread tension device and sewing machine frame 11 have the same structures as structures well known in a sewing machine and thus the detailed description thereof is omitted.

The sewing machine frame 11 includes a sewing machine bed part disposed in the lower part of the sewing machine main body, a vertical body part erected from one end of the sewing machine bed part, and a sewing machine arm part extended from the vertical body part to the sewing machine bed part in the same direction.

In the following description, a direction extending horizontally and along the longitudinal direction of the sewing machine bed part is defined as the X-axis direction, a direction extending horizontally and intersecting the X-axis direction at right angles is defined as the Y-axis direction, and a vertically upward and downward direction intersecting the X-axis direction and Y-axis direction at right angles is defined as the Z-axis direction.

Also, the sewing machine 100 includes a center presser 14 structured such that it can be pulled out from the fabric C smoothly when the sewing needle 12 rises. The center presser 14 is supported by the lower end of a center presser bar 141. The center presser 14 is a frame body into which the sewing needle 12 can be loosely fitted and, on receiving power through a well-known transmission mechanism from a sewing machine motor 30 (see FIG. 2) serving as a drive source for vertically moving the needle bar 13, moves vertically with a cycle equal to the needle bar 13 and with less amplitude than the needle bar 13. Here, the center presser 14 is out of phase with the needle bar 13 and, as the sewing needle 12 rises, it lowers. Also, the center presser 14 is set such that, in order not to disturb the movement of the fabric C, can provide some clearance with respect to the needle plate at the dead center position thereof.

Figure 2:
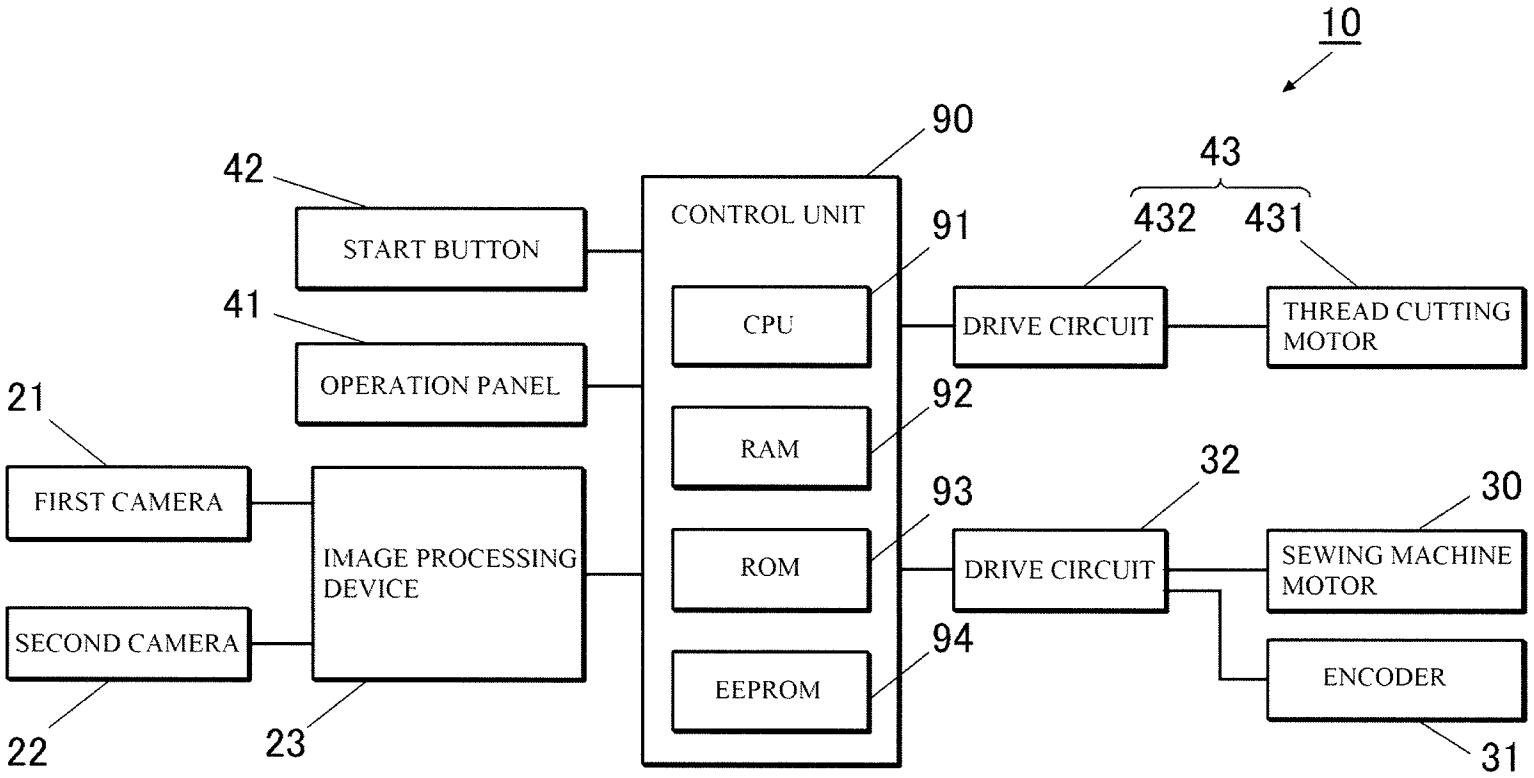
FIG. 2 is a block diagram of a control system of the sewing machine.

Also, the sewing machine 100, as shown in FIG. 2, includes a thread cutting device 43 for cutting the sewing thread at the end of sewing. The thread cutting device 43 includes a moving knife disposed below the needle plate capable of reciprocating so as to pass through just below a needle hole, a fixed knife for cutting the sewing thread in cooperation with the moving knife (none of the knives shown), a thread cutting motor 431 for reciprocating the moving knife, and a drive circuit 432 for driving the thread cutting motor 431 according to an instruction from the control unit 90.

The sewing machine 100 also includes first and second cameras 21 and 22 around the needle bar 13. The cameras 21 and 22 are fixedly supported by the sewing machine arm part so as to face downward and are arranged such that the needle drop position (needle hole) can be contained in the imaging ranges thereof.

Further, the first and second cameras 21 and 22, with their optical axes both in parallel to the Z-axis direction, are arranged symmetrically with respect to a plane containing the center line of the needle bar 13 and the center line of the center presser bar 141.

Thus, when imaging the fabric C on the needle plate, although the imaging ranges of the first and second cameras 21 and 22 are partially obstructed by the needle bar 13, center presser 14 and so on, the thus-obstructed range of one of the cameras 21 and 22 can be imaged by the other, whereby the whole periphery of the needle bar 13 can be imaged complementarily.

[Control System of Sewing Machine]

FIG. 2 shows the control system of the sewing machine 100.

The sewing machine 100 includes the control unit 90 for controlling the operations of the respective composing elements thereof and, to the control unit 90, there are connected through a drive circuit 32 the sewing machine motor 30 serving as the drive source for driving sewing operations and an encoder 31 for detecting the output shaft angle (upper shaft angle) of the motor.

Also, to the control unit 90, there is connected the thread cutting motor 431 of the thread cutting device 43 through the drive circuit 432.

Further, to the control unit 90, there is connected an image processing device 23 for performing predetermined image processes on data of images imaged by the first and second cameras 21 and 22.

Moreover, to the control unit 90, there are connected an operation panel 41 serving as an operating device from which the operator of the sewing machine can input an operation instruction into the sewing machine, and a start button 42 for starting sewing through their respective interfaces (not shown).

From the operation panel 41, for example, there is set a sewing pitch which is the length of a seam per stitch.

The control unit 90 mainly includes CPU 91 for controlling the sewing machine motor 30, RAM 92 serving as the operation area of CPU 91, ROM 93 in which programs to be processed by CPU 91 are stored, and EEPROM 94 serving as a storage part in which data used for arithmetic processing are stored and which is capable of rewriting the data.

[Sewing Pitch Adjusting Control]

Description is given of sewing pitch adjusting control to be performed by the control unit 90 of the sewing machine 100.

In the sewing pitch adjusting control, the sewing machine motor 30 is controlled in such a manner that the fabric C to be arbitrarily operated by the hand of a sewing machine operator so as to move on the sewing machine bed will be sewn while maintaining a sewing pitch set from the operation panel 41.

Figure 3:
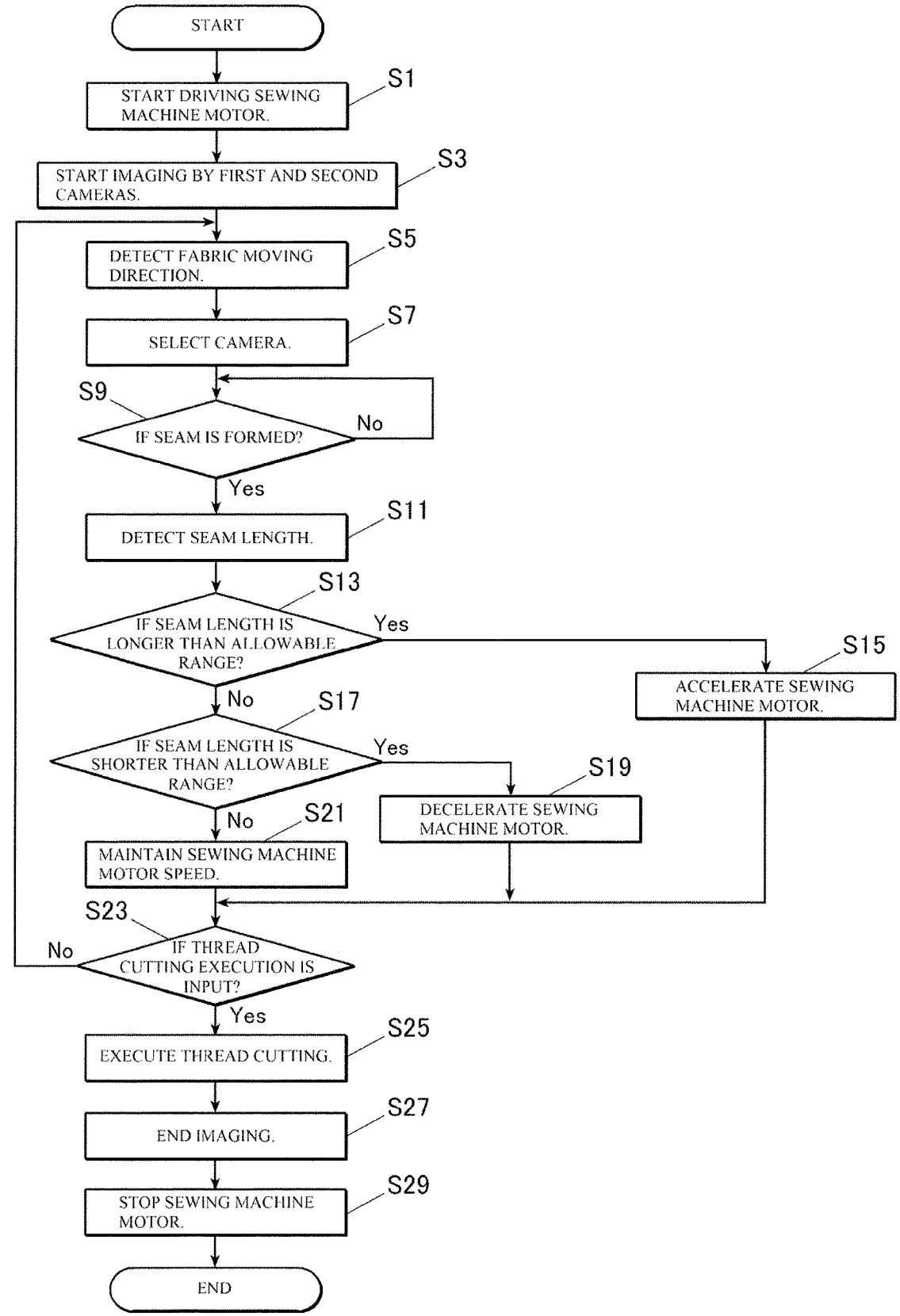
FIG. 3 is a flow chart of a sewing pitch adjusting control.

FIG. 3 shows a flow chart of the sewing pitch adjusting control to be performed by the control unit 90. Description is given sequentially of processes to be performed by the control unit 90 using this flow chart.

Firstly, CPU 91 of the control unit 90 starts driving the sewing machine motor 30 (Step S1).

And, the first and second cameras 21 and 22 are allowed to start imaging the fabric C on the needle plate (Step S3). Imaging of the fabric C by the first and second cameras 21 and 22 is executed repeatedly at a cycle sufficiently shorter than the cycle of the vertical movement of the needle bar 13, and image signals are sequentially input into the image processing device 23.

The image processing device 23 generates image data from the image signals, extracts characteristic parts within the imaging range from the image data currently obtained and the image data obtained just before the current data, and detects the moving direction of the characteristic parts of the two kinds of image data (Step S5).

This moving direction coincides with the moving direction of the fabric C.

And, CPU 91 decides from the fabric moving direction that the sewing pitch of a seam to be formed next should be obtained from which one of the image data of the first and second cameras 21 and 22 (Step S7).

Figure 4:
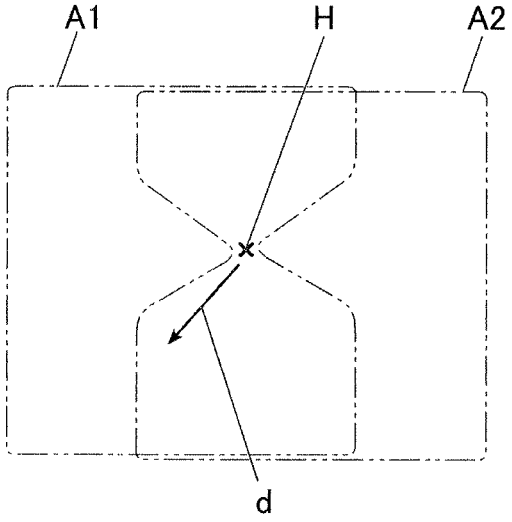
FIG. 4 is an explanatory view of the relationship between the moving direction of a fabric and the imaging range of a camera to be selected.

FIG. 4 shows the relationship between the imaging range A1 of the first camera 21, the imaging range A2 of the second camera 22 and the needle drop position H. As shown in FIG. 4, the imaging range A1 of the first camera 21 and the imaging range A2 of the second camera 22 are respectively formed to be wedge-like cutout shapes toward the needle drop position H, which, as described before, show the parts to be obstructed by the needle bar 13 and center presser 14.

As shown in FIG. 4, when the moving direction d of the fabric C is close to the side of any one of the cameras (for example, the side of the first camera 21) from the needle drop position H, in order to avoid the above obstructed parts, the first camera 21 capable of imaging the seam without being obstructed by the needle bar 13 and center presser 14 is selected.

And, after the camera selection, CPU 91 monitors from the output of the encoder 31 the arrival of an upper shaft angle for forming a new seam (for example, an upper shaft angle at which the sewing needle 12 lowers and pierces into the fabric C) (Step S9).

And, when the encoder 31 detects the arrival of the upper shaft angle for forming a new seam, CPU 91, using the image processing device 23, identifies a most recent seam from the image data obtained by the first camera 21 just after the new seam is formed, and detects the length of the most recent seam.

Figure 5:
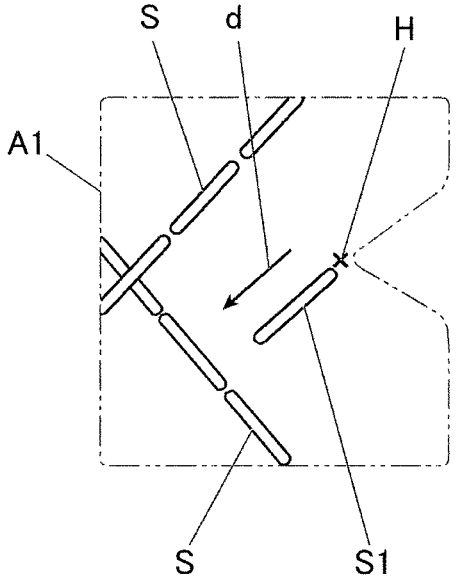
FIG. 5 is an explanatory view of the relationship between the fabric moving direction and the formation position of the most recent seam.

When the sewing has proceeded and multiple seams have been already formed on the fabric C, as shown in FIG. 5, within the imaging range A1, besides the most recent seam S1, multiple seams S can also be imaged.

Therefore, based on the moving direction of the fabric C obtained in Step S5, CPU 91 identifies, as the most recent seam S1, a seam extending along the moving direction d of the fabric C from the needle drop position H within the imaging range.

Further, the length of the identified most recent seam S1 is detected from the number of dots (number of pixels) occupied by the seam S1 within the images of the image data (Step S11).

Next, CPU 91 checks whether the detected length of the most recent seam S1 is longer than an allowable range (±10%) based on the set value of the sewing pitch or not (Step S13) and, when longer, CPU 91 controls the sewing machine motor 30 to increase the speed thereof (Step S15), thereby advancing the process to Step S23.

Here, the acceleration of the sewing machine motor 30 may be a predetermined value but, alternatively, a difference between the length of the most recent seam S1 and the sewing pitch set value may be obtained and the acceleration may be decided according to the size of the difference.

Also, when the detected length of the most recent seam S1 is determined not longer than the allowable range based on the sewing pitch set value, CPU 91 checks whether the detected length of the most recent seam S1 is shorter than the allowable range based on the sewing pitch set value or not (Step S17) and, when shorter, CPU 91 controls the sewing machine motor 30 to decrease the speed thereof (Step S19), thereby advancing the process to Step S23.

In this case as well, a value for reducing the acceleration of the sewing machine motor 30 may be a predetermined value but, alternatively, a difference between the length of the most recent seam S1 and the sewing pitch set value may be obtained, and the acceleration reducing value may be decided according to the thus-obtained difference.

Also, when the detected length of the most recent seam S1 is found not shorter than the allowable range based on the sewing pitch set value, CPU 91 determines that the length of the most recent seam S1 is within the allowable range based on the sewing pitch set value and the rotation speed of the sewing machine motor 30 provides a proper value to thereby maintain the current speed (Step S21).

Next, CPU 91 checks whether execution of thread cutting is input from the operation panel 41 or not (Step S23) and, when not input, it returns the process to Step S5; and, again, CPU 91 detects the moving direction of the fabric C from the image data provided by the first and second cameras and obtains the length of a new most recent seam S1, thereby performing the control for adjusting the rotation speed of the sewing machine motor 30.

Meanwhile, when the thread cutting execution is input from the operation panel 41, CPU 91 drives the thread cutting motor 431 to execute the thread cutting operation (Step S25).

After then, the imaging by the first and second cameras 21 and 22 is stopped (Step S27), and the driving of the sewing machine motor 30 is stopped (Step S29), thereby ending the sewing.

Technical Effects of Embodiment of the Invention

According to the above-structured sewing machine 100, the control unit 90 obtains the length of the most recent seam S1 from the image of the most recent seam S1 provided by one of the first and second cameras 21 and 22, compares the length of the most recent seam S1 with the set value of the sewing pitch, and corrects the number of rotations of the sewing machine motor 30 by increasing or decreasing it.

Therefore, an error generated in the actually formed seam S1 is reflected on the sewing pitch forming control and thus sewing can be performed in such a manner that the actual sewing pitch can be close to the sewing pitch set value more practically, thereby enabling enhanced sewing quality.

Also, in the sewing machine 100, as the imaging parts thereof, the first and second cameras 21 and 22 are arranged around the needle bar 13. Thus, even when a view is obstructed by the needle bar 13 and center presser 14, since a view obstruction range differs in each camera, the whole periphery of the needle drop position can be imaged complementarily; even when the fabric C is moved in either direction, the most recent seam S1 can be positively imaged; and, the sewing machine motor 30 can always be adjusted to a proper speed, thereby enabling more enhanced sewing quality.

Also, the control unit 90 of the sewing machine 100 obtains the moving direction d of the fabric C from the image of the fabric C imaged by the first or second camera 21 or 22, selects any one of the first and second cameras 21 and 22 based on the thus-obtained moving direction d, and compares the length of the most recent seam obtained from the image of the most recent seam S1 imaged by the selected one of the cameras 21 and 22 with the set value of the sewing pitch, thereby correcting the number of rotations of the sewing machine motor 30.

Thus, the most recent seam can be imaged properly without being obstructed by the needle bar 13 and so on, and the sewing machine motor 30 can always be adjusted to a proper speed, thereby enabling still more enhanced sewing quality.

Also, the control unit 90 of the sewing machine 100 obtains the moving direction d of the fabric C from the image of the fabric C imaged by the first or second camera 21 or 22, selects any one of the first and second cameras 21 and 22 based on the thus-obtained moving direction d, identifies the most recent seam S1 from the multiple seams imaged by one of the first and second cameras 21 and 22, and compares the length of the identified most recent seam S1 with the set value of the sewing pitch, thereby correcting the number of rotations of the sewing machine motor 30.

Therefore, even when the multiple seams S are imaged, the most recent seam S1 can be accurately identified, and the sewing machine motor 30 can always be adjusted to a proper speed, thereby enabling even more enhanced sewing quality.

[Others]

The control unit 90 of the sewing machine 100 may also obtain the moving direction d of the fabric C from the image thereof imaged by one of the first and second cameras 21 and 22, and may select use of both of an image captured by the first camera 21 and an image captured by the second camera 22.

In this case, the control unit 90 composes the images of the most recent seam S1 respectively captured by the first and second cameras 21 and 22 to obtain the length of the most recent seam S1, and compares the length of the most recent seam S1 with the set value of the sewing pitch, thereby correcting the number of rotations of the sewing machine motor 30. When composing the images, preferably, for example, the needle drop position in the image of the first camera 21 and the needle drop position in the image of the second camera 22 may be aligned with each other, and the two images may be combined with each other in such a manner to exclude the parts of the images where the fabric C is obstructed by the needle bar 13 and center presser 14, thereby forming a single image.

Thus, even when the most recent seam S1 is obstructed by the needle bar 13 and so on and cannot be imaged properly only by one of the first and second cameras 21 and 22, the length of the most recent seam S1 can be obtained and the sewing machine motor 30 can always be adjusted to a proper speed, thereby enabling yet more enhanced sewing quality.

Also, although, in this embodiment, there are used the two cameras 21 and 22, the number of cameras may also be increased. In this case, preferably, the cameras may be arranged at uniform angular intervals on a circumference around the center line of the needle bar 13, and each camera may be arranged such that the line of the sight (optical axis) thereof is directed downward in the vertical direction and the needle drop position H is contained therein.

The control to adjust the speed of the sewing machine motor 30 from the length of the imaged most recent seam S1 may also be applied to other sewing machines than the sewing machine adapted to perform the free motion sewing. For example, the control can also be applied to any sewing machine so long as it is capable of imaging the most recent seam S1.

Also, the length of the imaged most recent seam S1 may also be detected by other methods than the method using the number of dots occupying the image of the image data. For example, the imaged most recent seam S1 can also be detected by detecting the multiple characteristic points of the seam from the image of the image data and obtaining the length between the characteristic points.

The invention claimed is:

1. A sewing machine, comprising: a sewing machine motor serving as a drive source for driving the vertical movement of a needle bar; and, a control part for controlling the sewing machine motor such that a sewing pitch coincides with a set value, wherein, there is further included an imaging part for imaging a seam formed in a workpiece at a needle drop position, and the control part obtains the length of a most recent seam formed in the workpiece from an image of the most recent seam imaged by the imaging part and also compares the length of the most recent seam with the set value of the sewing pitch to thereby correct the number of rotations of the sewing machine motor.

2. The sewing machine according to claim 1, wherein the imaging part includes multiple imaging devices having different imaging ranges with respect to the workpiece and being arranged around the needle bar.

3. The sewing machine according to claim 1, wherein the imaging part includes multiple imaging devices having different imaging ranges with respect to the workpiece, and wherein the control part obtains the moving direction of the workpiece from images of the workpiece imaged by the multiple imaging devices, selects one of the multiple imaging devices according to the thus-obtained moving direction, obtains the length of the most recent seam from the image imaged by the selected imaging devices, and compares the length of the most recent seam with the set value of the sewing pitch to thereby correct the number of rotations of the sewing machine motor.

4. The sewing machine according to claim 2, wherein the control part obtains the moving direction of the workpiece from the images of the workpiece imaged by the multiple imaging devices, composes the images of the most recent seam imaged by the multiple imaging devices to obtain the length of the most recent seam, and compares the length of the most recent seam with the set value of the sewing pitch to thereby correct the number of rotations of the sewing machine motor.

5. The sewing machine according to claim 3, wherein the control part obtains the moving direction of the workpiece from the image of the workpiece imaged by any one of the multiple imaging devices.

6. The sewing machine according to claim 4, wherein the control part obtains the moving direction of the workpiece from the image of the workpiece imaged by any one of the multiple imaging devices.

7. The sewing machine according to claim 1, wherein the control part obtains the moving direction of the workpiece from the image of the workpiece imaged by the imaging part, according to the thus-obtained moving direction, identifies from multiple seams imaged by the imaging part a seam extending along the moving direction as the most recent seam, and compares the length of the identified most recent seam with the set value of the sewing pitch to thereby correct the number of rotations of the sewing machine motor.

8. The sewing machine according to claim 2, wherein the control part obtains the moving direction of the workpiece from the image of the workpiece imaged by the imaging part, according to the thus-obtained moving direction, identifies from multiple seams imaged by the imaging part a seam extending along the moving direction as the most recent seam, and compares the length of the identified most recent seam with the set value of the sewing pitch to thereby correct the number of rotations of the sewing machine motor.

9. The sewing machine according to claim 3, wherein the control part obtains the moving direction of the workpiece from the images of the workpiece imaged by the multiple imaging devices, according to the thus-obtained moving direction, identifies from multiple seams imaged by the multiple imaging devices a seam extending along the moving direction as the most recent seam, and compares the length of the identified most recent seam with the set value of the sewing pitch to thereby correct the number of rotations of the sewing machine motor.

10. The sewing machine according to claim 4, wherein the control part obtains the moving direction of the workpiece from the images of the workpiece imaged by the multiple imaging devices, according to the thus-obtained moving direction, identifies from multiple seams imaged by the multiple imaging devices a seam extending along the moving direction as the most recent seam, and compares the length of the identified most recent seam with the set value of the sewing pitch to thereby correct the number of rotations of the sewing machine motor.

11. The sewing machine according to claim 5, wherein the control part obtains the moving direction of the workpiece from the images of the workpiece imaged by the multiple imaging devices, according to the thus-obtained moving direction, identifies from multiple seams imaged by the multiple imaging devices a seam extending along the moving direction as the most recent seam, and compares the length of the identified most recent seam with the set value of the sewing pitch to thereby correct the number of rotations of the sewing machine motor.

12. The sewing machine according to claim 6, wherein the control part obtains the moving direction of the workpiece from the images of the workpiece imaged by the multiple imaging devices, according to the thus-obtained moving direction, identifies from multiple seams imaged by the multiple imaging devices a seam extending along the moving direction as the most recent seam, and compares the length of the identified most recent seam with the set value of the sewing pitch to thereby correct the number of rotations of the sewing machine motor.

* * * * *